US012616300B2

(12) United States Patent
Trice et al.

(10) Patent No.: US 12,616,300 B2
(45) Date of Patent: May 5, 2026

(54) MOUNTING ARRANGEMENT FOR OVER-THE-RANGE COOKING APPLIANCE

(71) Applicant: Midea Group Co., Ltd., Beijiao (CN)

(72) Inventors: Daniel J. Trice, Louisville, KY (US); Brian M. Langness, Shelbyville, KY (US)

(73) Assignee: MIDEA GROUP CO., LTD., Beijiao (CN)

( * ) Notice: Subject to any disclaimer, the term of this patent is extended or adjusted under 35 U.S.C. 154(b) by 219 days.

(21) Appl. No.: 18/214,463

(22) Filed: Jun. 26, 2023

(65) Prior Publication Data

US 2024/0423363 A1 Dec. 26, 2024

(51) Int. Cl.
*A47B 77/08* (2006.01)

(52) U.S. Cl.
CPC ..... *A47B 77/08* (2013.01)

(58) Field of Classification Search
CPC ..... H05B 6/6429; F16M 13/02; A47B 77/08; A47B 95/008
See application file for complete search history.

(56) References Cited

U.S. PATENT DOCUMENTS

| | | | |
|---|---|---|---|
| 2,739,521 | A | 3/1956 | Spear |
| 3,627,248 | A | 12/1971 | Nelson |
| 3,804,211 | A | 4/1974 | Scherzinger |
| 3,814,363 | A | 6/1974 | Brelosky |
| 3,954,244 | A | 5/1976 | Gopstein |
| 3,970,273 | A | 7/1976 | Tanner |
| 4,012,058 | A | 3/1977 | Patton |
| 4,313,043 | A | 1/1982 | White |
| 4,327,274 | A | 4/1982 | White et al. |
| 4,453,690 | A | 6/1984 | Takeuji |
| 4,457,436 | A | 7/1984 | Kelley |
| 4,465,256 | A | 8/1984 | Wolbrink et al. |
| 4,580,853 | A | 4/1986 | Hitzeroth et al. |
| 4,584,986 | A | 4/1986 | Cannata |
| 4,635,615 | A | 1/1987 | Itoh |
| 4,659,047 | A | 4/1987 | Haller |
| 4,666,113 | A | 5/1987 | Itoh et al. |
| 4,720,622 | A | 1/1988 | Iwata et al. |
| 4,753,406 | A | 6/1988 | Kodama et al. |
| 4,795,121 | A | 1/1989 | Comito |
| 4,796,850 | A | 1/1989 | Aramaki |

(Continued)

FOREIGN PATENT DOCUMENTS

| | | | |
|---|---|---|---|
| AT | 411925 | B | 7/2004 |
| CN | 1704653 | A | 12/2005 |

(Continued)

OTHER PUBLICATIONS

Bargero, John E., United States Patent and Trademark Office, Final Office Action issued in U.S. Appl. No. 17/353,666, 36 pages, dated May 14, 2024.

(Continued)

*Primary Examiner* — Matthew W Ing
(74) *Attorney, Agent, or Firm* — Gray Ice Higdon

(57) ABSTRACT

A mounting bracket for an appliance, such as an over-the-range cooking appliance, for mounting to an underside of a structure. The bracket may be configured to be secured to the wall near the structure and configured to support the appliance. The bracket may include one or more pivoting mechanisms.

25 Claims, 11 Drawing Sheets

(56) References Cited

U.S. PATENT DOCUMENTS

| | | | |
|---|---|---|---|
| 4,824,061 | A | 4/1989 | Sumikama et al. |
| 4,898,149 | A | 2/1990 | Cohn |
| 5,014,945 | A | 5/1991 | Miller |
| 5,096,230 | A | 3/1992 | Pausch et al. |
| 5,257,468 | A | 11/1993 | Lebrun |
| 5,318,328 | A | 6/1994 | Dawson |
| 5,482,232 | A | 1/1996 | Wynn |
| 5,590,641 | A | 1/1997 | Duong |
| 5,676,440 | A | 10/1997 | Garber et al. |
| 6,018,158 | A | 1/2000 | Kang |
| 6,222,171 | B1 | 4/2001 | Fukuda et al. |
| 6,341,754 | B1 | 1/2002 | Melito et al. |
| 6,369,372 | B1 | 4/2002 | Kim |
| 6,512,214 | B2 | 1/2003 | Jeong et al. |
| 6,554,880 | B1 | 4/2003 | Northcutt |
| 6,584,702 | B2 | 7/2003 | Irey |
| 6,660,984 | B1 | 12/2003 | Jeong et al. |
| 6,737,622 | B1 | 5/2004 | Jeong et al. |
| 6,894,259 | B2 | 5/2005 | Lee |
| 6,894,260 | B2 | 5/2005 | Yamauchi |
| 7,030,348 | B1 | 4/2006 | Kim |
| 7,129,452 | B2 | 10/2006 | Cho |
| 7,282,683 | B2 | 10/2007 | Yamauchi et al. |
| 7,348,527 | B2 | 3/2008 | Braunisch |
| 9,243,734 | B2 | 1/2016 | Aubert et al. |
| 9,719,251 | B2 | 8/2017 | Gosling |
| 9,897,330 | B2 | 2/2018 | Bruin-Slot et al. |
| 9,897,331 | B2 | 2/2018 | Bruin Slot |
| 10,018,365 | B2 | 7/2018 | Bruin-Slot et al. |
| 10,145,054 | B2 | 12/2018 | Federico |
| 10,197,202 | B2 | 2/2019 | Vasquez |
| 10,302,308 | B2 | 5/2019 | Peng |
| 10,317,093 | B2 | 6/2019 | Bruin-Slot et al. |
| 10,539,329 | B2 | 1/2020 | Gauthier et al. |
| 10,633,783 | B1 | 4/2020 | Kelley |
| 10,660,438 | B2 | 5/2020 | Hognaland |
| 10,663,175 | B2 | 5/2020 | Jang |
| 10,709,240 | B2 | 7/2020 | Hira et al. |
| 11,460,193 | B2 | 10/2022 | Gayakwad |
| 11,864,296 | B2 | 1/2024 | Scalf et al. |
| 2005/0052018 | A1 | 3/2005 | Pichotta |
| 2005/0178763 | A1 | 8/2005 | Yamauchi |
| 2009/0252548 | A1 | 10/2009 | Laible |
| 2016/0003270 | A1 | 1/2016 | Franklin |
| 2016/0195279 | A1 | 7/2016 | Naber |
| 2016/0341432 | A1 | 11/2016 | Sinur |
| 2017/0065077 | A1 | 3/2017 | Behroozi |
| 2018/0192807 | A1 | 7/2018 | Hall |
| 2018/0340695 | A1 | 11/2018 | Park |
| 2019/0113241 | A1 | 4/2019 | Zhang et al. |
| 2019/0203881 | A1 | 7/2019 | Wu |
| 2019/0223593 | A1 | 7/2019 | Hira |
| 2020/0224676 | A1 | 7/2020 | Gazerro |
| 2020/0292291 | A1 | 9/2020 | Duz |
| 2020/0373743 | A1 | 11/2020 | Chambers |
| 2022/0141927 | A1 | 5/2022 | Scalf et al. |
| 2022/0400850 | A1 | 12/2022 | Trice |
| 2022/0400860 | A1* | 12/2022 | Trice ..... F16M 11/041 |
| 2022/0404030 | A1 | 12/2022 | Trice |
| 2022/0404031 | A1 | 12/2022 | Trice |
| 2023/0404260 | A1 | 12/2023 | Trice et al. |
| 2024/0147584 | A1 | 5/2024 | Scalf |

FOREIGN PATENT DOCUMENTS

| | | | |
|---|---|---|---|
| CN | 108344018 | A | 7/2018 |
| CN | 210241107 | U | 4/2020 |
| DE | 3839931 | A1 | 5/1990 |
| DE | 4340255 | A1 | 6/1995 |
| DE | 10128026 | A1 | 12/2002 |
| DE | 10357575 | A1 | 7/2004 |
| DE | 102005057153 | A1 | 5/2007 |
| DE | 102005057160 | A1 | 5/2007 |
| DE | 102010055986 | A1 | 5/2012 |
| EP | 0130029 | A1 | 1/1985 |
| GB | 2142669 | A | 1/1985 |
| KR | 880000748 | Y1 | 3/1988 |
| KR | 880002241 | Y1 | 6/1988 |
| KR | 19980030344 | U | 8/1998 |
| KR | 19980030345 | U | 8/1998 |
| KR | 19980036833 | U | 9/1998 |
| KR | 19980045009 | U | 9/1998 |
| KR | 19990032462 | A | 5/1999 |
| KR | 20000010025 | A | 2/2000 |
| KR | 100244311 | B1 | 3/2000 |
| KR | 20010055487 | A | 7/2001 |
| KR | 200271639 | Y1 | 4/2002 |
| KR | 20030059878 | A | 7/2003 |
| KR | 20070065133 | A | 6/2007 |
| KR | 20080057729 | A | 6/2008 |
| KR | 20110002949 | U | 3/2011 |
| WO | 2017037247 | A1 | 3/2017 |

OTHER PUBLICATIONS

Sterling, Amy Jo., United States Patent and Trademark Office, Notice of Allowance issued in U.S. Appl. No. 17/089,196, 46 pages, dated Aug. 2, 2023.

Sterling, Amy Jo, United States Patent and Trademark Office, Non-Final Office Action issued in U.S. Appl. No. 18/400,809, 54 pages, dated Nov. 12, 2024.

Salone, Bayan, United States Patent and Trademark Office, Notice of Allowance issued in U.S. Appl. No. 17/353,654, 150 pages, dated Apr. 10, 2024.

Tran-Le, Thao Uyen, United States Patent and Trademark Office, Final Office Action issued in U.S. Appl. No. 17/353,647, 51 pages, dated Aug. 15, 2024.

Tran-Le, Thao Uyen, Non-Final Office Action issued in U.S. Appl. No. 17/353,647, 111 pages, dated Apr. 26, 2024.

Namay, Daniel Elliot, Non-Final Ofice Action issued in U.S. Appl. No. 17/353,671, 218 pages, dated Jan. 18, 2024.

Bargero, John E., United States Patent and Trademark Office, Non-Final Office Action issued in U.S. Appl. No. 17/353,666, 53 pages, dated Nov. 6, 2023.

Bargero, John E., United States Patent and Trademark Office, Non-Final Office Action issued in U.S. Appl. No. 17/353,666, 40 pages, dated Sep. 29, 2024.

Salone, Bayan, United States Patent and Trademark Office, Notice of Allowance issued in U.S. Appl. No. 18/210,983, 71 pages, dated Sep. 30, 2024.

Fulton Store, Side Mount Heavy Duty Steel Furniture Leg Leveling Feet, Adjustable Height with Round Foot Ideal for Desks, Tables, Shelving Units, Shop Cabinets and Furniture, retrieved from: https://www.amazon.com/Adjustable-Furniture-Levelers-Shelving-Cabinets/dp/B06ZXSXL5Z, Retrieved on: Jun. 9, 2023.

Mason Ind., 20,000 lb Capacity, 3-1/2 Wide x 6" Long, 1/2" Pad, Wedge Jack, retrieved from: https://www.mscdirect.com/product/details/88000906; Retrieved on: Jan. 30, 2023.

Wobble Wedges Store, Wobble Wedge BigGap Rigid Plastic Shims, Multipurpose Wdges for Home Improvement & Work, Leveling Pads for Large Gaps & Heavy Loads, Furniture Appliance Levelers, Retrieved from: https://www.amazon.com/Wobble-Wedges-BigGap-Plastic-Shims/dp/B08KVV6JRM?th=1; Retrieved on: Jan. 30, 2023.

Majestic, Majestic BKTLA7C LED TV Wall Mount Slide Bracket for Easy TV Removal, Retrieved from: https://majesticelectronics.us/tv-mounts/16-majesetic-bktla7c-led-tv-wall-mount-bracket-easy-remove.html , Retrieved on Oct. 27, 2020.

MagVent, MagVent MV-90 Magnetic Dryer Vent Coupling, Amazon.com, Retrieved from https://www.amazon.com/MagVent-MV-90-Magnetic-Dryer-Coupling/dp/B013TI7A4S, Retrieved on Dec. 9, 2020.

MagVent, MagVent Dryer Vent, Retrieved from: https://www.magvent-dryervent.com/, Retrieved on Apr. 7, 2021.

Nardi, Tom, 3D Printed Magnetic Dust Port Keeps Shop Clean, Hackaday, Aug. 29, 2018.

Transmittal of Related Applications dated Jun. 26, 2023.

* cited by examiner

MOUNTING ARRANGEMENT FOR OVER-THE-RANGE COOKING APPLIANCE

BACKGROUND

Cooking appliances, and in particular microwave cooking appliances, are commonly used for residential cooking, and are often installed over a range or cooktop. The installation of an over-the-range cooking appliance over a range or cooktop is a lengthy process and often requires two individuals to complete. Furthermore, installation of these units may necessitate drilling many holes into the surrounding cabinetry. During installation of a typical over-the-range cooking appliance, a first individual may be required to hold the appliance in position underneath a wall cabinet while a second individual drives several mounting screws through the wall cabinet from within the interior of the wall cabinet. Such an operation may also be complicated by the need to level or properly close one or more gaps, or portions thereof, between the appliance/bracket and the underside of the cabinet.

Accordingly, a need continues to exist in the art for a manner of simplifying mounting of an over-the-range cooking appliance, and in some instances, allowing for an individual to pivot a cooking appliance over a range or cooktop.

SUMMARY

The herein-described embodiments address these and other problems associated with the art by providing a mounting bracket and/or appliance that is configured for mounting to a wall. The bracket/appliance, or portions thereof, may include one or more pivot mechanisms.

In some embodiments, an over-the-range cooking appliance may be configured for mounting to an underside of a wall cabinet. In various embodiments, the over-the-range cooking appliance may include a housing including a cooking cavity configured to receive food. In some embodiments, the appliance may include a bracket configured to support the housing. In various embodiments, the bracket may include a body and a threaded member threadably coupled to the body, wherein rotation of the threaded member relative to the body is configured to pivot the bracket and/or housing upwardly towards the underside of the wall cabinet.

In addition, in some embodiments, the threaded member may include a proximal end and a distal end. In some embodiments, the distal end includes a pad. In various embodiments, the body of the bracket may rotatably fixe the pad thereto. In some embodiments, the pad may rotate with the threaded member. In various embodiments, the pad of the distal end may be rotated from a first axial position proximate the body of the bracket to a second axial position distal from the body. In some embodiments, a distal end of the threaded member may be configured to contact a wall disposed proximate to the wall cabinet. In various embodiments, the body may include a rear facing side and a front facing side. In some embodiments, an axis of the threaded member may be angled relative to the rear facing side facing a wall disposed proximate to the wall cabinet. In various embodiments, the body may include a bottom wall. In some embodiments, the bottom wall may include a recess configured to access and drive the threaded member. In some embodiments, the threaded member may be proximate a bottom end of the body of the bracket and a pivoting axis of the body of the bracket is proximate a top end of the body of the bracket. In various embodiments, the threaded member may be threaded in a linear direction between a stowed position within the body of the bracket and a deployed position different from the stowed position, when in the stowed position the bracket is pivoted less than when in the deployed position. In some embodiments, the bracket may be pivoted upwardly towards the underside of the wall cabinet when rotating the threaded member.

In some embodiments, a mounting bracket for an over-the-range cooking appliance may include a body having a fastener mechanism and/or a pivoting mechanism. In various embodiments, the fastener mechanism may be adjacent a top end of the body and/or the pivoting mechanism may be adjacent a bottom end of the body. In some embodiments, the pivoting mechanism may include a threaded aperture within the body. In various embodiments, the pivot mechanism may include a threaded member rotatably engaging the threaded aperture between a stowed position and a deployed position different from the stowed position. In various embodiments, the body of the bracket may be in a first pivot position about the fastener mechanism when in the stowed position and a second pivot position about the fastener mechanism different from the first pivot position.

In addition, in some embodiments, a length of the threaded member may be increased away from the threaded aperture from the stowed position towards the deployed position. In various embodiments, the threaded member may include a proximal end configured to be operated by the user and a distal end configured to engage a wall. In some embodiments, the proximal end of the threaded member may include a pad rotational fixed or freely rotatable relative to a remaining portion of the threaded member. In some embodiments, the body may include a top wall, a bottom wall, and a plurality of side walls connecting the top wall to the bottom wall. In various embodiments, the bottom wall may include the pivoting mechanism. In some embodiments, the threaded member may be rotatable about a rotational axis transverse to a rear-facing surface of the bracket body.

In some embodiments, a method of pivoting a mounting bracket for an over-the-range cooking appliance may include providing a mounting bracket. In various embodiments, the mounting bracket may be configured to support the over-the-range cooking appliance. In some embodiments, the method may include fastening the mounting bracket to a wall disposed proximate to an underside of a wall cabinet. In various embodiments, the method may include rotating a threaded member of the mounting bracket. In some embodiments, the method may include pivoting the mounting bracket upwardly to narrow a gap between the mounting bracket and the underside of the wall cabinet.

In addition, in some embodiments, the method may include placing the over-the-range cooking appliance on the mounting bracket. In various embodiments, placing the over-the-range cooking appliance on the mounting bracket occurs after pivoting the mounting bracket. In some embodiments, the method may include pivoting the over-the-range cooking appliance to narrow the gap. In various embodiments, rotating the threaded member is from within the mounting bracket. In some embodiments, rotating the threaded member is at an angle relative to the wall. In various embodiments, the method may include deploying the threaded member from a stowed position within the mounting bracket. In some embodiments, the method may include narrowing the gap with a plurality of the threaded members.

These and other advantages and features, which characterize the invention, are set forth in the claims annexed hereto. For a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
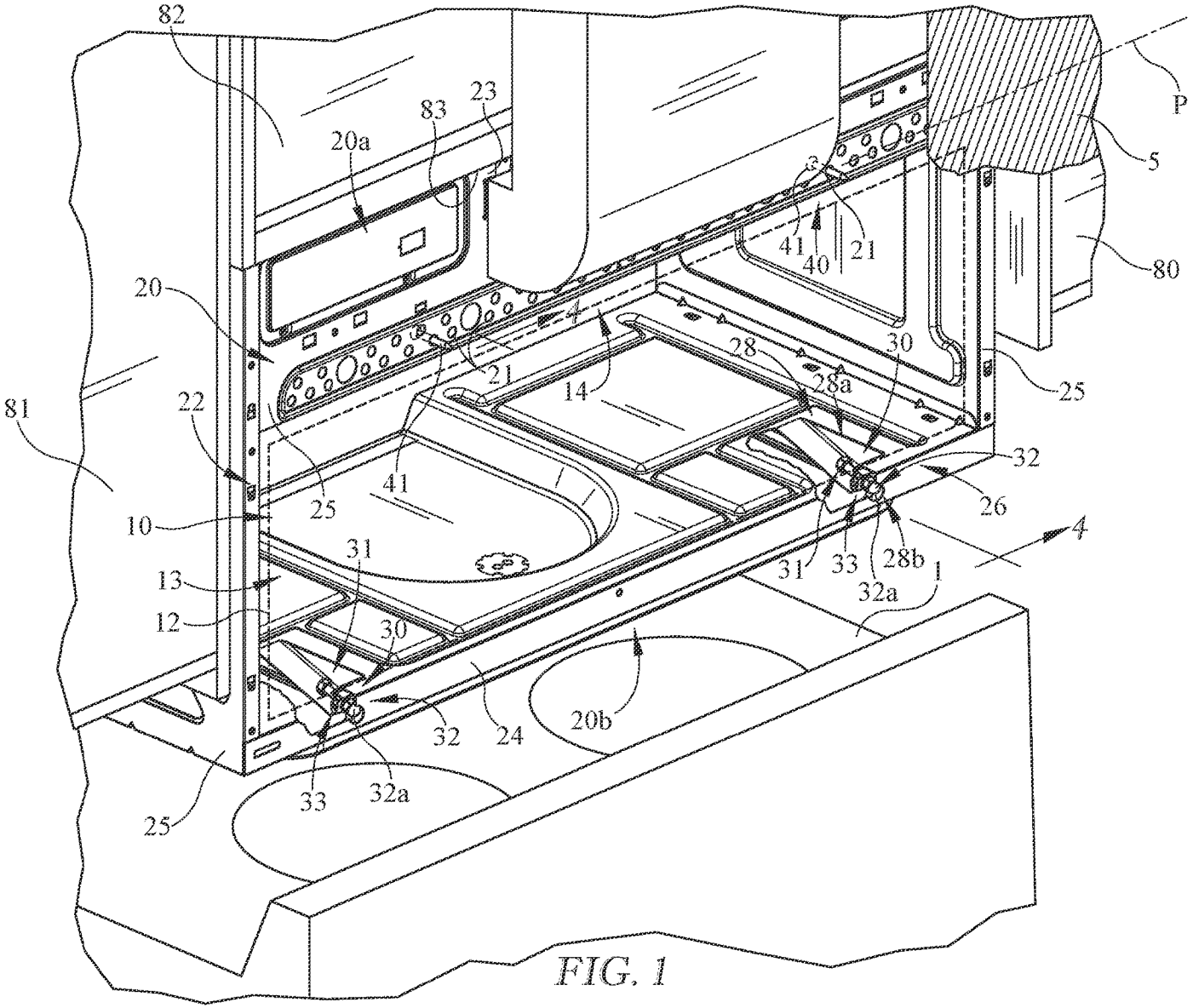
FIG. 1 is a rear perspective view of an over the range appliance/bracket, illustrated in broken lines, in a typical cabinet environment, according to an embodiment.
Figure 2:
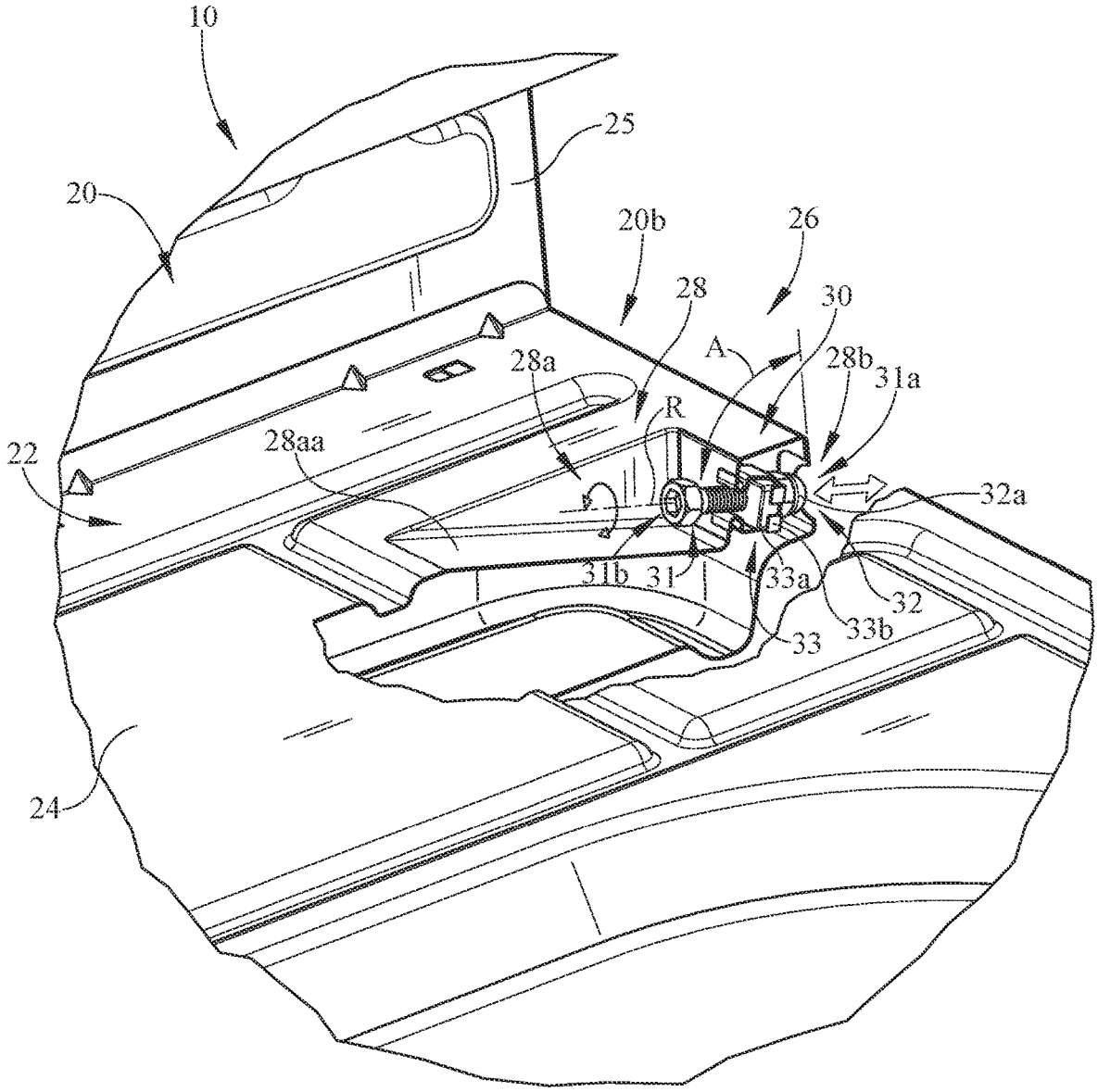
FIG. 2 is a perspective view with portions of a mounting bracket broken away to illustrate an embodiment of the pivot mechanism.
Figure 3:
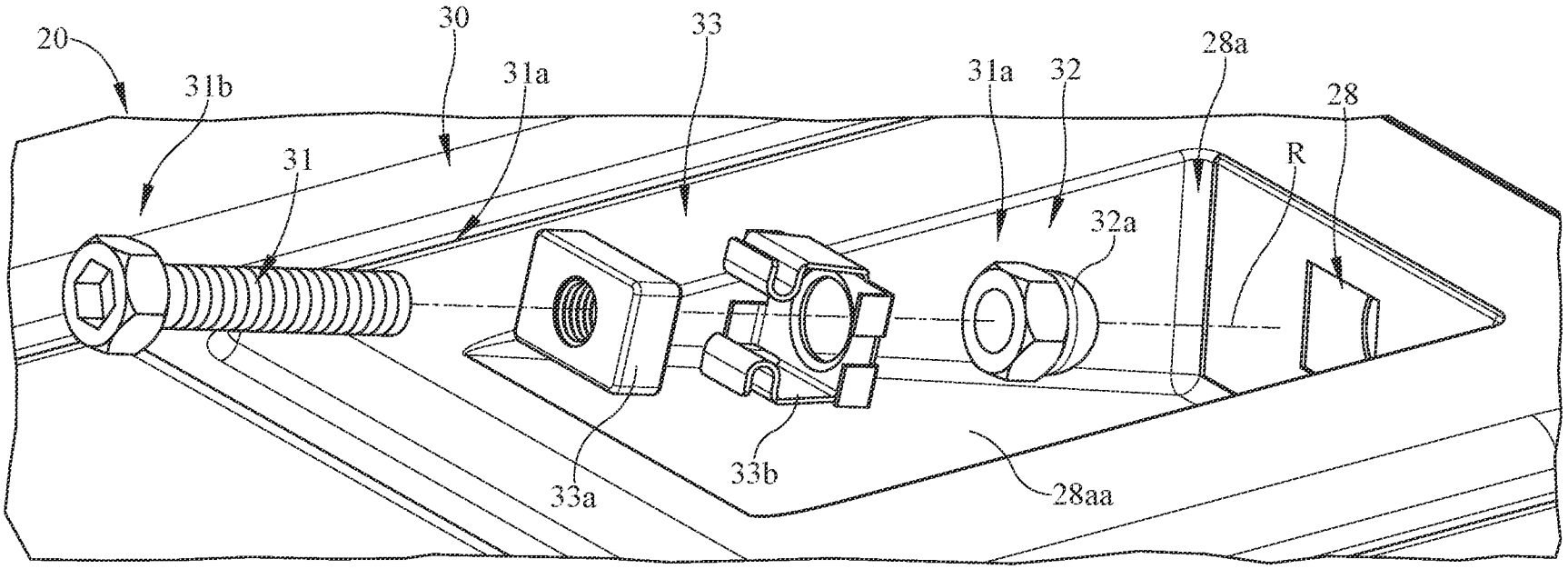
FIG. 3 is an exploded view of the pivot mechanism of FIG. 2

The embodiments discussed hereinafter are directed in part to an over-the-counter cooking appliance, mounting bracket, mounting kit, and method thereof that utilize a bracket 20 that is mounted on a wall/cabinet and that incorporates one or more pivoting mechanisms 30 to facilitate the mounting of the cooking appliance 10. The appliance and/or microwave bracket, in particular, may implement a unique threaded driving mechanism in which the front of an enclosure 12/bracket 20 of the cooking appliance 10 may be tilted/pivoted upwardly while the rear of the enclosure/bracket is supported on the wall to effectively close or vary the space/position/gap G between bracket/enclosure with the underside of the cabinet. The illustrated embodiments hereinafter focus on a microwave cooking appliance, but it will be appreciated that the herein-described techniques may be used to mount other types of over-the-range cooking appliances, so the invention is not limited to use with microwave cooking appliances.

As described previously, over-the-range (e.g. OTR) microwave cooking appliances typically require multiple people to install. A first person (and indeed many times two people) may be required to lift and/or hold the microwave in place, for example on a wall bracket, while a second person may be required to insert one or more mounting screws downwardly through a bottom of the upper wall cabinet, and thread the screws into the OTR microwave cooking appliance. Common mounting bracket systems for OTR appliances require a wall bracket mounted to a back wall (behind the appliance) as well as screws or bolts drilled through an upper cabinet that fasten the appliance to the upper cabinet and enable the appliance to be drawn up tight against a lower side of the upper cabinet. There continues to be a need for a manner of mounting such a cooking appliance and hardware for the same that would allow a single person to install, or even if multiple people participate in the installation, to substantially simplify the installation process. Additionally, there is a need for an OTR microwave mounting system to not require drilling holes through the upper cabinet in order to support the OTR microwave or to draw the OTR appliance up to the lower/under side of the upper cabinet.

An improved OTR microwave cooking appliance mounting bracket that can be installed more easily, and in many instances by a single person, is described herein, which may reduce the need to locate and drill holes into the upper cabinet to support the appliance and/or draw the appliance/bracket up tight against a bottom surface of the upper cabinet (e.g. narrow the gap). Such a cooking appliance may include an enclosure/housing 12 with a cooking cavity for food; the enclosure having at least a rear-facing side 13 and a top-facing side 14. The microwave also includes a wall bracket/case/outer shell 20 secured to the wall proximate the wall cabinet that may support the enclosure 12. The bracket may have one or more pivoting mechanisms 30 near the rear-facing side 13 (e.g. top/bottom end) of the enclosure. The pivoting mechanism 30 may pivot/tilt the housing 12/bracket 20 upwardly and/or about a pivot axis and/or fastener mechanism 40 of the bracket. In many instances, a single person may be able to place the over-the-range microwave oven onto or to the wall bracket 20 and then rotate or pivot/tilt the front of the cooking appliance 10 and/or bracket 20 upwardly in order to close/narrow the gap G, if any, between bracket/housing and the wall cabinet or upper structure (e.g. obstacle).

Figure 7:
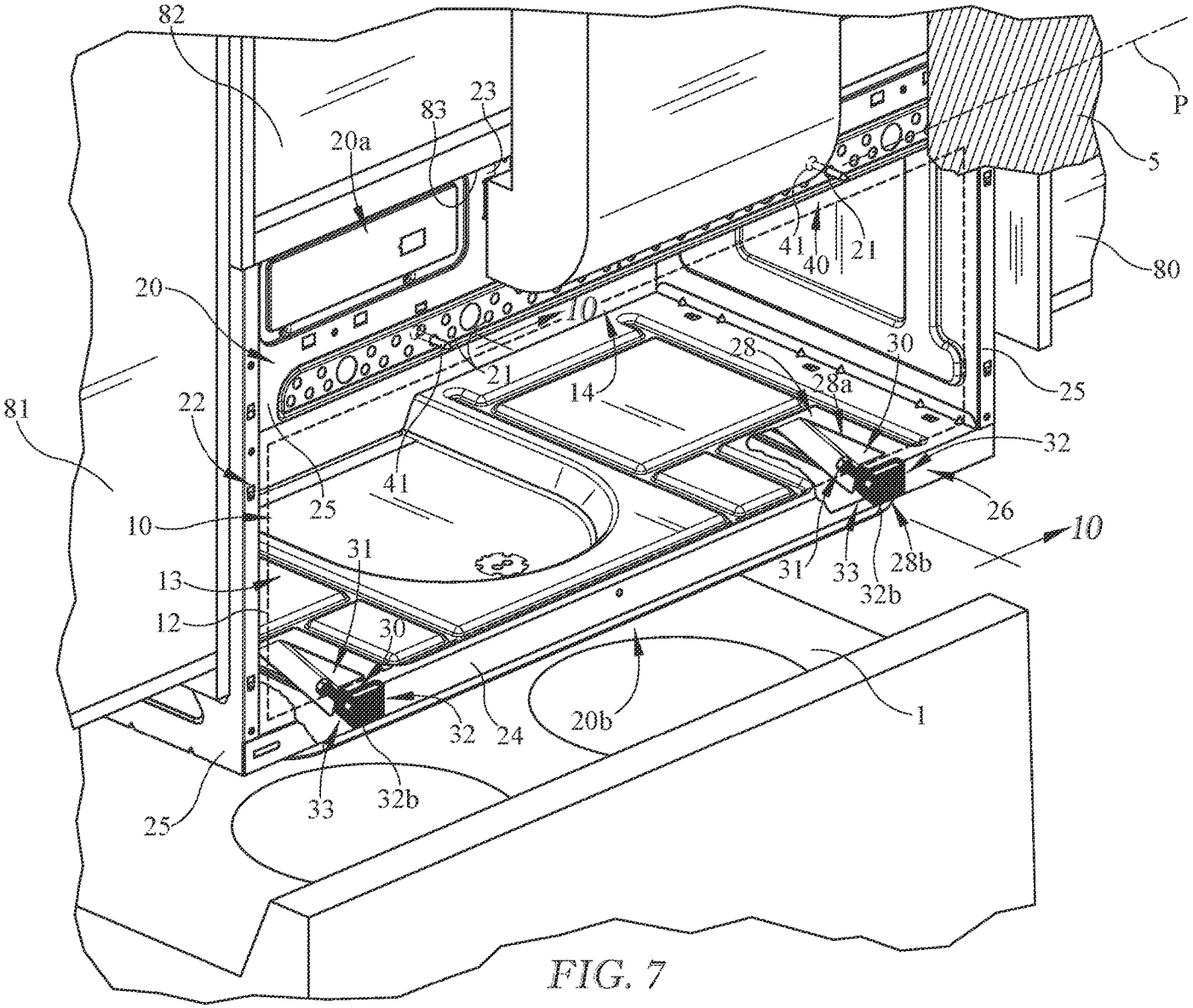
FIG. 7 is a rear perspective view of an over the range appliance/bracket, illustrated in broken lines, in a typical cabinet environment, according to another embodiment.
Figure 8:
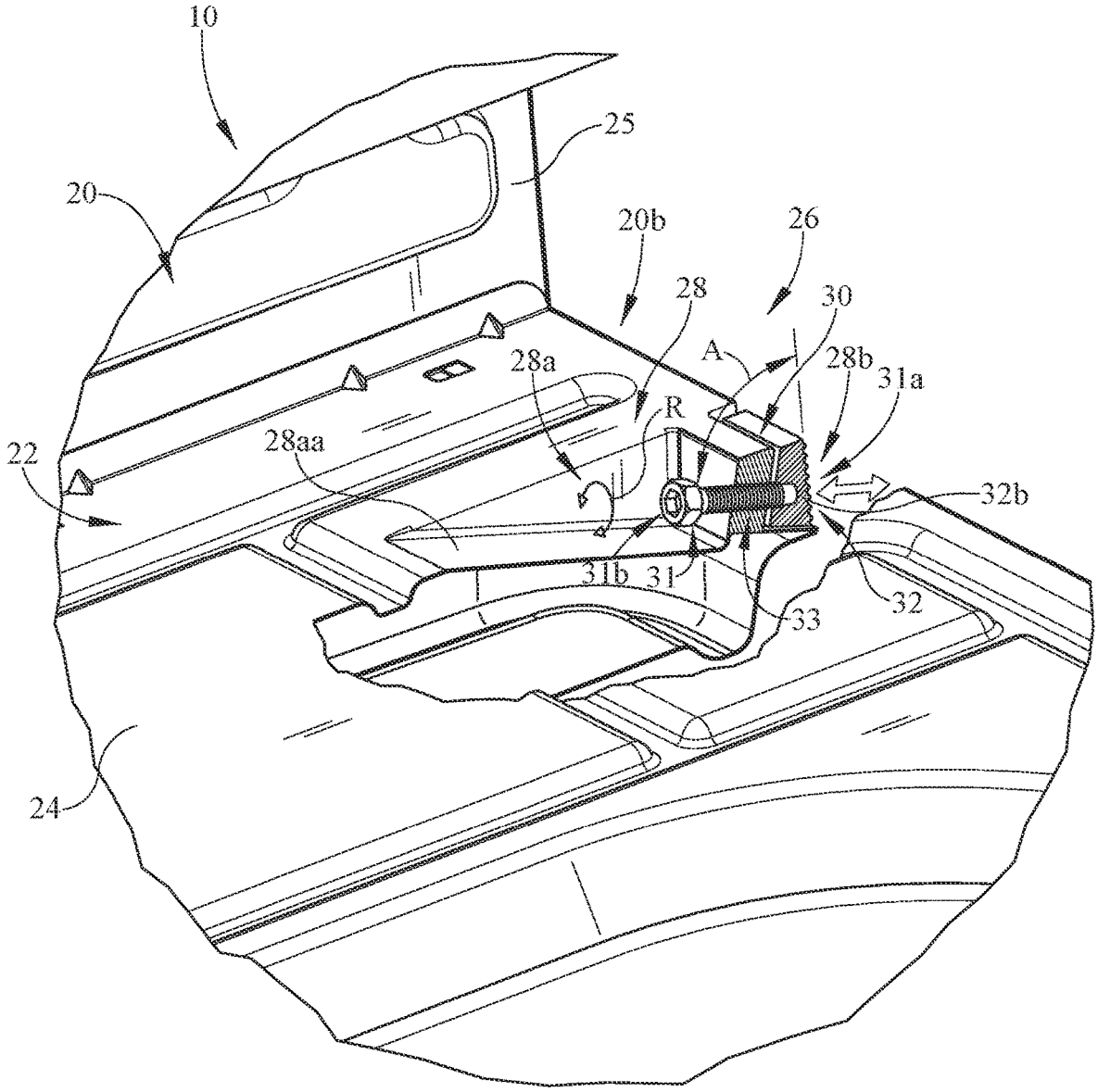
FIG. 8 is a perspective view with portions of a mounting bracket broken away to illustrate an embodiment of the pivot mechanism.
Figure 9:
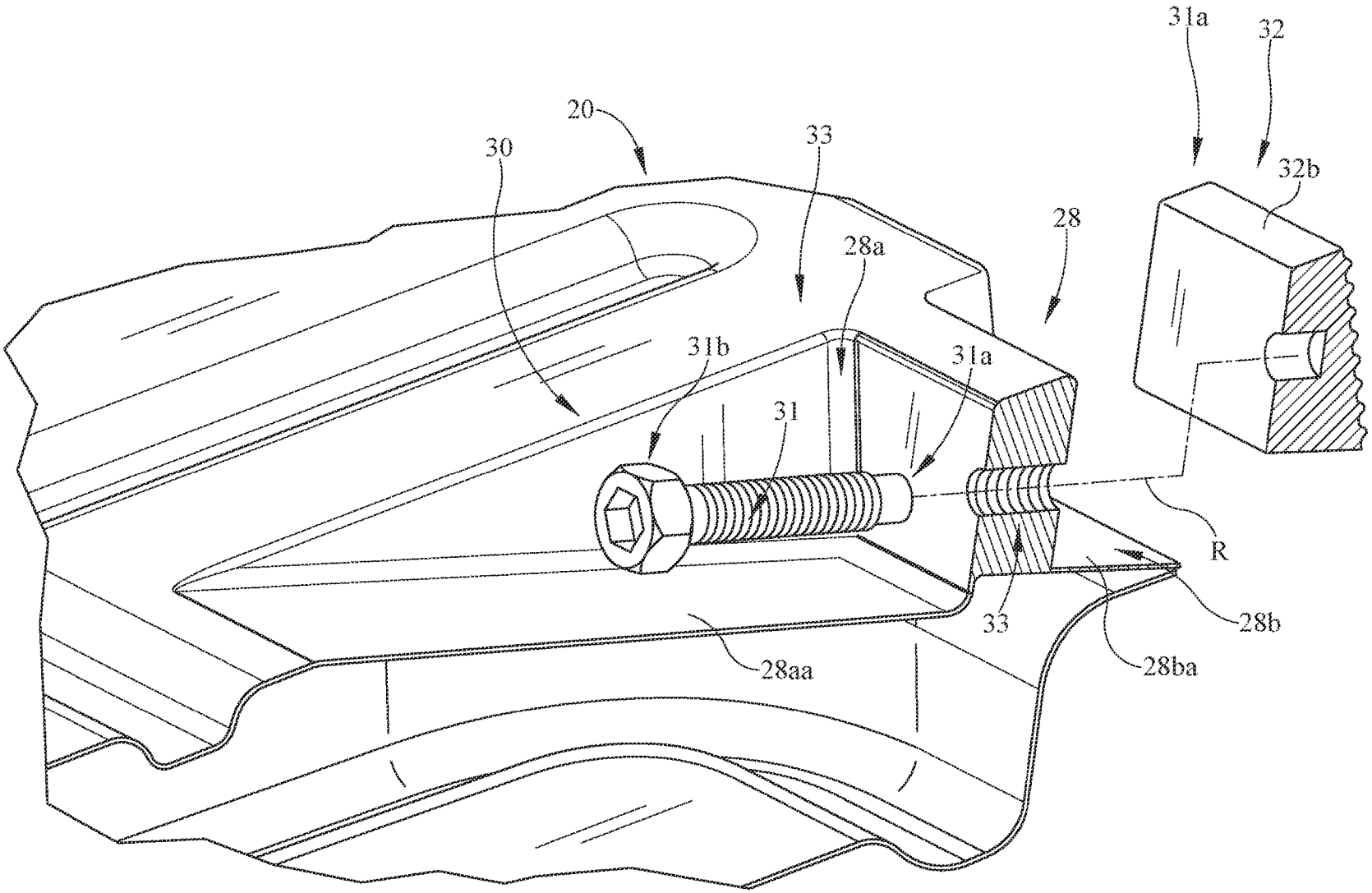
FIG. 9 is an exploded view of the pivot mechanism of FIG. 8

Turning now to the drawings, wherein like numbers denote like parts throughout the several views, FIGS. 1-11 illustrates an example appliance 10 mounted in a typical OTR location in which the various apparatus, systems, and methods using the mounting bracket 20 described herein may be implemented. Such OTR microwaves offer several advantages over a countertop microwave, including that they do not take up valuable counter space and they may provide a neater appearance to the kitchen. Additionally, OTR microwave cooking appliances may have built-in exhaust fans that serve as a stovetop ventilation system to minimize smoke, steam, and cooking odors. The appliance 10 illustrated in Figures may be installed over the stove or range 1. In some embodiments, the appliance/bracket do not have to be installed over the stove or range. FIGS. 1 and 7 illustrates a typical cabinet layout or design, with a first wall cabinet 80 and a second wall cabinet 81 installed on a wall 5 with a space therebetween to receive the OTR appliance. Also between the first and second wall cabinets 80, 81 is an upper wall cabinet 82 below which the OTR appliance 10 is to be mounted. The term wall cabinet refers to a cabinet typically disposed over a countertop or any cabinet not a base-type cabinet that typically supports a counter. Furthermore, the term "wall" may refer to any substantially vertical support structure, and that may be intermediate structures to which the wall bracket is directly attached. The upper wall cabinet 82 has a bottom surface 83. In some instances, the upper wall cabinet 82 may comprise or contain functional cabinetry for storage; while in other instances, it may be decorative or consist of just cabinet framing or other obstacle. The cabinet layout design illustrated in the Figures is not to be construed as limiting, and may vary based on the specifics of any particular kitchen layout. For example, in some instances, the over-the-range microwave may be flanked on one side by a wall (e.g. where the microwave is located in a corner) and on a second side by a cabinet, or one side may be open.

The appliance 10 shown is a residential-type microwave cooking appliance, and as such includes a housing or enclosure 12, which further includes a cooking cavity (not illustrated), as well as a door disposed adjacent the respective opening of the cooking cavity (e.g. near the front-facing side). In typical appliance embodiments, the door may further include a window that allows a user to view the items inside the cooking cavity. In some embodiments, in place of, or in addition to, the handle (not illustrated), the appliance 10 may include a button that a user may press to trigger the opening of the door.

Although not relevant to the features of the embodiments described herein, the typical appliance 10 may also include one or more user activated controls, which may be in the form of buttons, knobs, a touchscreen, or the like. In some embodiments, these user activated controls may be used to program a cooking time and/or a cooking power level. In addition, in some embodiments, these user activated controls may be used to select one or more preset conditions for a particular food item to be cooked or a particular desired action (e.g. "popcorn", "defrost", "frozen pizza", etc.). In some embodiments, the preset conditions may include one or more adaptive thermal sensing cycles such as an auto-defrost or auto-cook cycle, which are described in greater detailed herein. The appliance 10 may also include a display, which may be used to convey a variety of information to a user. For example, in some embodiments, the display may be used to display the time when the appliance 10 is not in use. In other embodiments, the display may be used to display cooking times, power levels and/or temperatures.

In some implementations, the mounting bracket may include one or more pivoting mechanisms 30. The pivot mechanism 30 may lift the mounting bracket 20 and/or appliance 10, or portions thereof, upwardly to narrow one or more gaps G during the mounting of the appliance/bracket. If a gap G is remaining once the mounting bracket and/or appliance is in a position (e.g. first pivot position), the one or more pivot mechanisms 30 may be used to fine tune the gap G and/or are located at or near the bottom rear of the microwave and/or bottom end 20*b* of the bracket, or portions thereof. The pivot mechanism 30 creates a force to rotate the top front edge of the microwave case and/or bracket, or portions thereof, up and close the gap. The bracket/appliance, or portions thereof, may pivot/tilt (e.g. upwardly) between a first pivot position (See FIGS. 4 and 10) and a second pivot position (See FIGS. 5 and 11) different from the first pivot position via the pivot mechanism.

In some implementations, the mounting bracket 20 and/or appliance 10 may include one or more fastener mechanisms 40. The one or more fastener mechanisms 40 may secure the bracket to the wall. The one or more fastener mechanisms 40 may be adjacent the pivot axis P of the bracket 20 and/or appliance 10 (e.g. housing). The bracket/appliance, or portions thereof, may pivot about the one or more fastener mechanisms 40. The pivot axis P may be spaced away from or above the pivot mechanism. In the one embodiment shown in the Figures, the one or more fastener mechanisms may be one or more screws or bolts 41 passing through one or more apertures 21 of the body 22 (e.g. rear wall, side wall, member) and into the studs/wall 5. The fastener may allow pivoting of the bracket/appliance. In some embodiments, the one or more fastener mechanisms 40/bracket 20 may not be fully secured or tightened to the wall 5 to allow pivoting/tilting of the bracket/appliance upon operation of the pivoting mechanism 30. Upon tilting/pivoting, the one or more fasteners/bracket may be fully secured (e.g. tightened) to the wall, or portions thereof. The other embodiments, the fastener/bracket/member may be fully secured and still allow pivoting. It should be understood that the fastener mechanism 40 may be a variety of shapes, sizes, quantities, positions, and constructions and still be within the scope of the invention.

In some implementations, the mounting bracket 20 may include a body 22. The body 22 and/or bracket 20 may support the appliance housing/enclosure 12. The body 22 may include a top end or upper portion 20*a* and a bottom end or lower portion 20*b*. The top end 20*a* may be proximate the wall cabinet 82 and/or wall 5 and the bottom end 20*b* may be distal from the wall cabinet 82 and/or proximate the wall 5. The body 22 may include one or more fastener mechanisms 40 and/or pivoting axis P adjacent the top end 20*a* and/or the one or more pivot mechanisms 30 (e.g. threaded member 31) adjacent the bottom end 20*b*. The wall bracket 20 (e.g. microwave, bracket members, outer shell, case, body, etc.) can be stamped metal or an extruded aluminum member, as two non-limiting examples. Although the mounting bracket is shown as an outer shell of the appliance, a variety of mounting brackets may be used. In some implementations, the outer shell/case 22 may include a top wall 23, a bottom wall 24, and one or more side walls 25 connecting the top wall and the bottom wall. One side wall 25 may be a rear wall with a rear-facing side 26 and an opposing appliance/front-facing side 27. The rear wall or side wall 25 may include the one or more fastener mechanisms 40. Although the bottom wall 16 is shown as including the one or more pivot mechanisms 30, it should be understood that the one or more side walls (e.g. rear wall, lateral walls between front and rear, top wall) and/or bottom wall may include the pivot mechanism. The mounting bracket 20 may be a variety of shapes, sizes, quantities, and constructions and still be within the scope of the invention. For example, although the bracket is a single piece, it should be understood that the bracket may be two or more members/brackets (e.g. first member/bracket, second member/bracket, etc.). Further for example, in some embodiments, the first bracket may include the fastener and the second bracket may include the pivot mechanism. Although the bracket may include the pivot mechanism fastened/secured to the wall, in some embodiments, the bracket and/or pivot mechanism, or portions thereof, may be secured to the appliance.

In some implementations, the pivot mechanism 30, bracket 20 (e.g. body), and/or appliance 10, or portions thereof, may include a driving mechanism to pivot the bracket/appliance, or portions thereof. In the one embodiment shown, the driving mechanism is a threaded member 31 rotatably engaging a threaded aperture 33. The pivot mechanism 30 and/or threaded member may bias/force/pivot the bracket/appliance about the pivot axis P or upwardly or away from the wall 5 and/or range 1. The bracket 20 may be pivoted upwardly towards the underside 83 of the wall cabinet 82 when rotating the threaded member 31. In some embodiments, the bracket may be pivoted away from underside of the wall cabinet when rotating the threaded member. The threaded member 31 may be threadably coupled to the body 22 (e.g. threaded aperture, one or more walls) or bracket 20. As shown in the one embodiment, the threaded member 31 is coupled to the bottom wall 24 or bottom end 20*b* of the bracket 20 (e.g. threaded aperture) and/or spaced below/away from the fastener 41/fastener mechanism 40/hinge/pivot axis P. The bracket/body (e.g. bottom wall/end, side wall) may include the threaded aperture 33. The threaded aperture/member 31, 33 may travel along or define a rotational axis R. The rotational axis R may be at an angle A or transverse to the wall or rear facing side/surface, opposing to the front facing side, of the body/bracket. The threaded member/aperture/angle may be an acute angle or angled upwardly from the wall. For example, not parallel to the vertical wall 5 in some embodiments. The threaded member 31 may travel along the rotational axis R in a linear direction (e.g. first direction, opposing directions). Rotation of the threaded member relative to the body/aperture may pivot/tilt the bracket/housing upwardly towards the underside of the wall cabinet or structure. This may level the bracket/appliance and/or narrow the gap G. The drive mechanism may be a variety of shapes, sizes, quantities, positions, orientations, and constructions and still be within the scope of the invention. For example in some embodiments, the rotational axis R may be perpendicular to the wall 5.

Figure 4:
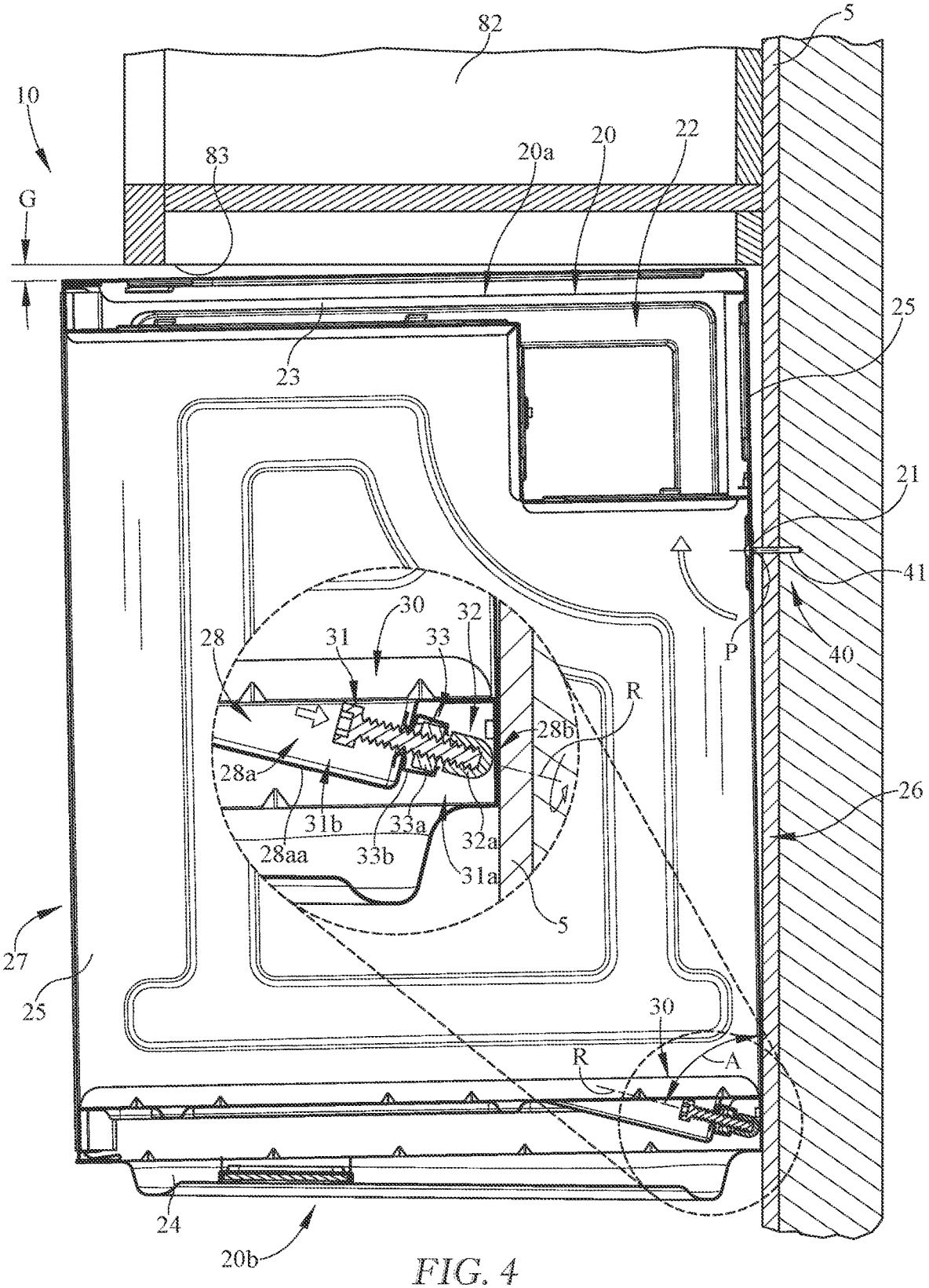
FIG. 4 is a sectional view taken along ling 4-4 of FIG. 1 illustrating a gap between the bracket/appliance and the underside of the cabinet wall, a first pivot position, and/or the pivot mechanism in a stowed position.
Figure 5:
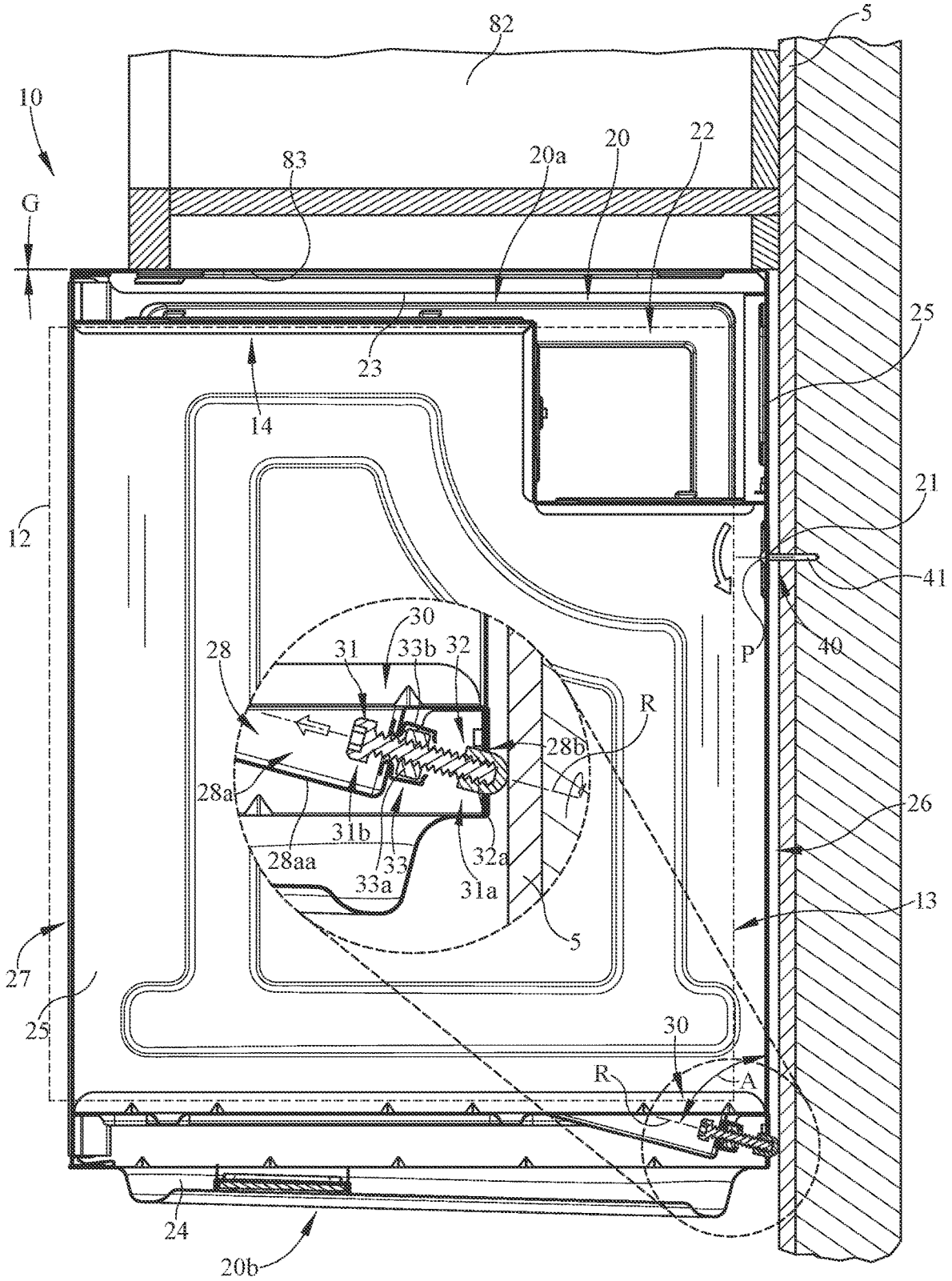
FIG. 5 is a sectional view taken along ling 4-4 of FIG. 1 illustrating the narrowed/closed gap between the bracket/appliance and the underside of the cabinet wall, a second pivot position, and/or the pivot mechanism in a deployed position.
Figure 6:
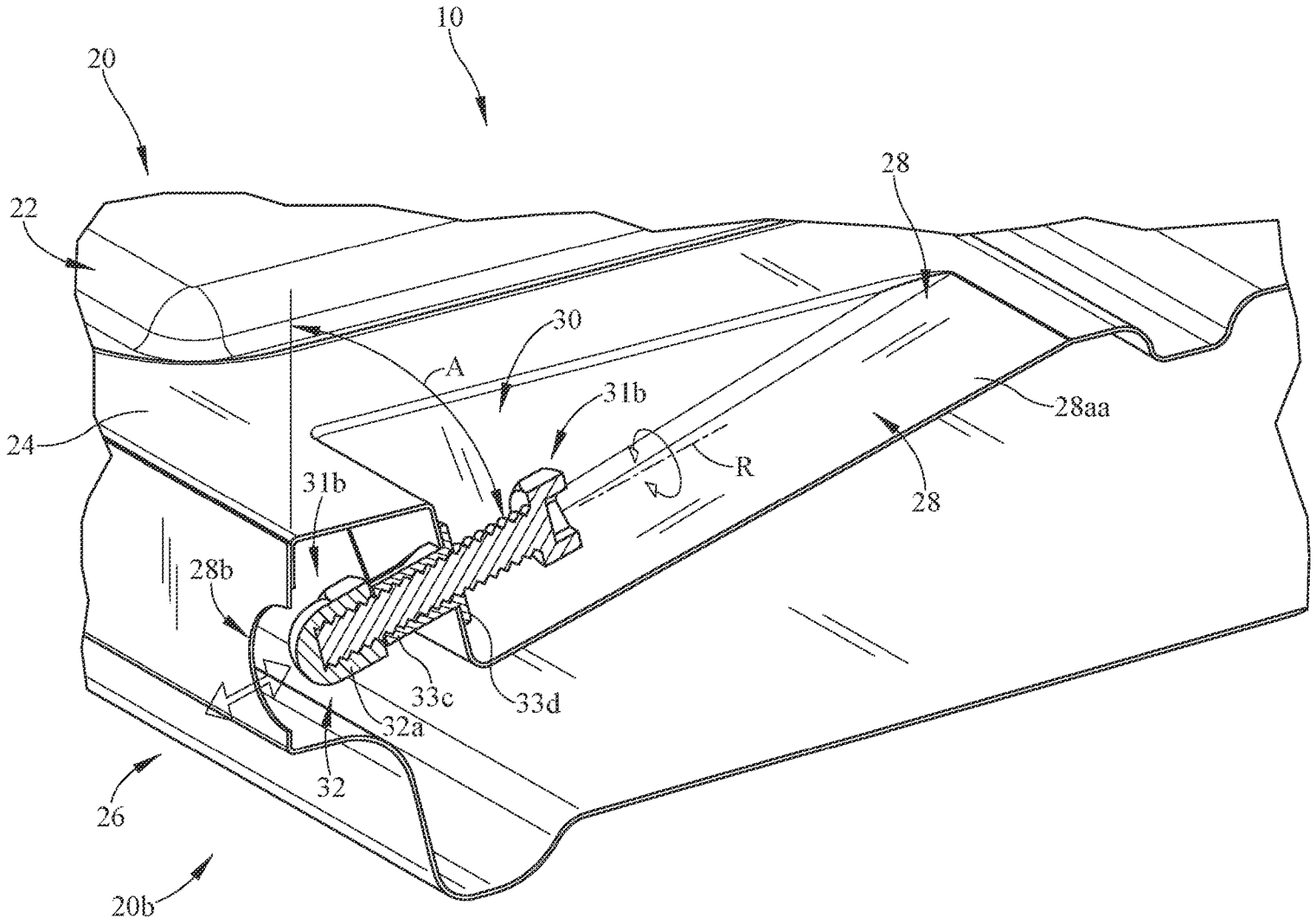
FIG. 6 is a sectional view of the pivot mechanism illustrating another embodiment of the threaded engagement.
Figure 10:
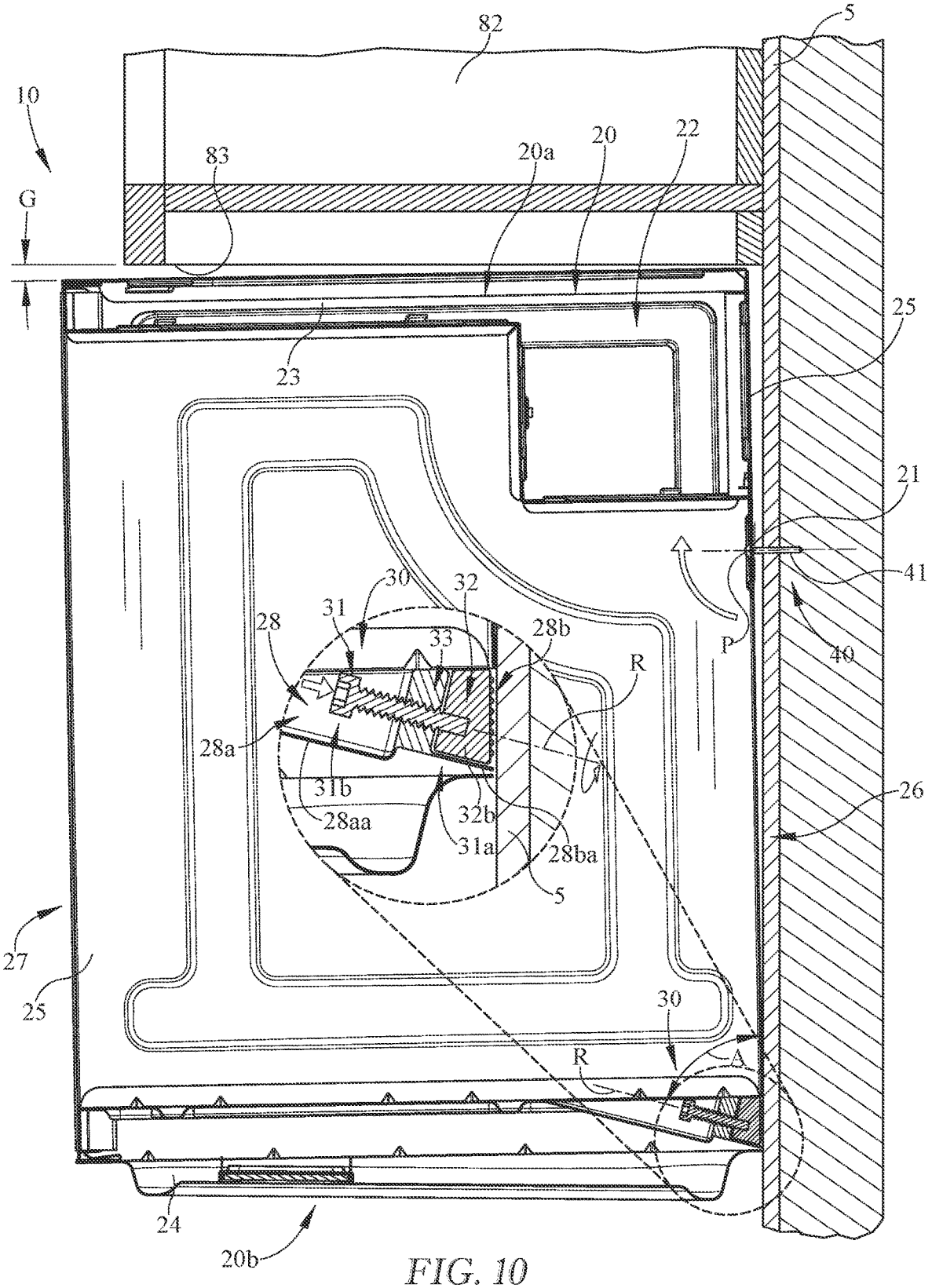
FIG. 10 is a sectional view taken along ling 10-10 of FIG. 7 illustrating a gap between the bracket/appliance and the underside of the cabinet wall, a first pivot position, and/or the pivot mechanism in a stowed position.
Figure 11:
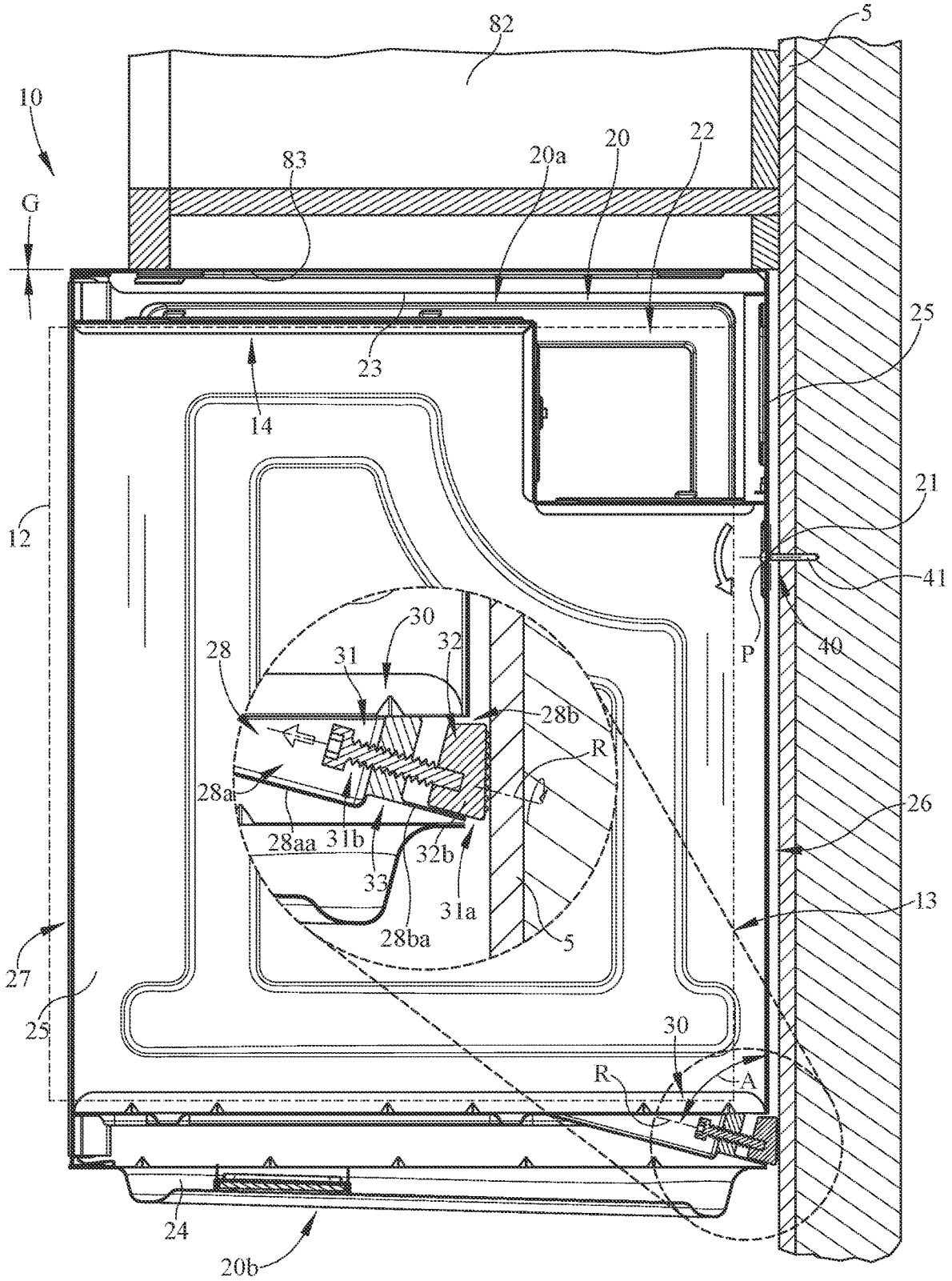
FIG. 11 is a sectional view taken along ling 10-10 of FIG. 1 illustrating the narrowed/closed gap between the bracket/appliance and the underside of the cabinet wall, a second pivot position, and/or the pivot mechanism in a deployed position.

In some implementations, the pivot mechanism 30, threaded member 31, appliance 10, and/or bracket 20 may be configurable between at least one stowed position and at least one deployed position. The deployed position being different from the stowed position. In the one embodiment shown, the threaded member 31, or portions thereof, may be rotatably engaged with the threaded aperture 33 or portions of the bracket between the stowed position (See FIGS. 1, 2, 4, 6-8, and 10) and the deployed position (See FIGS. 5 and 11). The bracket/appliance (e.g. body, housing) may be in a first pivot position when in the stowed position and a second pivot position when in the deployed position. The pivot position(s) (e.g. stowed, deployed) may be about the one or more fastener mechanisms 40 and/or pivot axis P. Rotating the threaded member 31 relative to the threaded aperture/body 33 (e.g. between the stowed and deployed positions) pivots (e.g. tilts, forces, biases) the appliance/bracket 10, 20 between the first pivot position and the second pivot position. In the first pivot position as shown in FIGS. 4 and 10, the gap G may be open or broader. In the second pivot position as shown in FIGS. 5 and 11, the gap G may be closed or narrowed. When in the stowed position, the threaded member 31 may be recessed or within the outer extent of the bracket/body/threaded aperture. When in the deployed position, the threaded member may be deployed or project away from the bracket/body/threaded aperture. Further, when in the deployed position or rotated in a first rotational direction, the length of the threaded member may increase away from the stowed position or project more from the threaded aperture or bracket/body. When rotated in a reverse/second rotational direction, the threaded member may decrease in length or project less from the threaded aperture or bracket/body and/or the gap may be increased, if desired. When in the stowed position, the bracket/appliance is pivoted/tilted (e.g. upwardly) less than when in the deployed position.

In some implementations, the threaded member, pivot mechanism, and/or appliance may include a distal end 31*a* abutting the wall/surface 5 in one or more pivot positions. As shown in the one embodiment, the threaded member 31 may include a proximal end 31*b* and a distal end 31*a*. The proximal end 31*b* may be engaged/operated by the user with or without a tool to rotate the threaded member 31. The distal end 31*a* or portions of the threaded member or pivot mechanism may be deployed from the stowed position to the deployed position. The distal end 31*a* (e.g. pad 32, if used) may be configured to engage/contact the wall/surface 5 (e.g. proximate the wall cabinet). In some embodiments, the distal end 31*a* or threaded member 31 or pivot mechanism 30 may include one or more pads 32. The pads 32 may be, but is not limited to, plastic, rubber, foam, metal, or combinations thereof. The pads may protect the wall 5 when contacted. Further, the pads or threaded member may reduce vibration to or from the appliance when contacting the wall or be of a vibration reducing material. The pads or threaded member (e.g. distal end) may be heat resistant.

In some implementations, the one or more pads 32 and/or distal end 31*a* may rotate independently or dependently relative to the threaded member (e.g. rotation), or portions thereof. Although the independently rotating pad 32 or distal end 31*a* may freely rotate relative to the threaded member 31 (e.g. end, attachment thereto, remaining portion) or sometimes with the threaded member 31, the pad 32 or distal end 31*a* may not rotate upon sufficient outside forces applied thereto. For example, as shown in FIGS. 7-11, the rotatable pad 32 or distal end 31*a* may not be allowed to rotate because of the surfaces/guides/recess/structure of the bracket (e.g. body) when the threaded member rotates and moves the pad in the linear direction. Alternatively stated, the body or recess of the bracket body rotatably fixes the pad thereto. Further for example as shown in FIGS. 1-6, although the rotatable pad 32*a* or distal end 31*a* is not inhibited from rotating via the bracket body, the rotatable pad may contact the wall with sufficient force/friction/interference to reduce or prevent rotation of the pad during translation or at one or more bracket/appliance pivot angles. A variety of structure may allow rotation of the pad or distal end relative to the remaining portion of the threaded member such as, but is not limited to, a bearing, joint, rivet, radial bearing, axial lock, etc. The rotationally dependent pad may rotate with the threaded member's rotation when rotationally fixed (e.g. welded) to the remaining portion of the threaded member in some embodiments. Although the pad or distal end may be fixed in-line or orientated at one angle with the threaded member as shown, the pad or distal end may swivel or be moveable between one or more angles via a swivel, ball joint, joint, etc. The threaded member may be rotated to position the one or more pads, if used, along the rotational axis R between one or more axial/linear positions. The pad, if used, or distal end may be positioned or translated from a first axial position proximate the bracket body (e.g. stowed position, aperture) to a second axial position distal away from the bracket body (e.g. deployed position) along the rotational axis R.

In some implementations, the pad, if used, may be a variety of shapes, sizes, quantities, and constructions. Referring to FIGS. 1-6, the pad 32 may be cup shaped and/or cylindrical pad 32*a*. The pad 32*a* may have an arcuate distal free end (e.g. convex). The pad 32*a* may not engage the bracket wall, recess, or through opening when the threaded member 31 is rotated. The pad 32*a* may be rotatably attached or fixed to the remaining portion of the threaded member. In the one embodiment in FIGS. 7-11, the pad 32 may be wedge shaped or non-cylindrical pad 32*b* (e.g. rotatable). The pad 32*b* may have a planar distal free end. The pad 32*b* may engage the bracket wall, recess, or through opening when the threaded member 31 is rotated. The pad 32*b* (e.g. outer periphery) may engage the bracket structure (e.g. inner periphery) and may not allow rotation of the pad when rotating the threaded member 31. The remaining portion of the threaded member 31 may push/pull/carry the pad in the linear direction along the rotational axis R. The pad 32 (e.g. 32*b*) may have a texture or pattern on the abutting surface or distal free end to provide additional friction and/or reduce vibration.

In some implementations, the force applied to the wall from the pivoting mechanism 30 may be in-line with the rotational axis R of the threaded member 31. When rotating the threaded member 31, the force to pivot/tilt the bracket/appliance may be parallel to the rotational axis R of the threaded aperture/member.

In some implementations, the pivot mechanism 30, or portions thereof, may be in a variety of positions within/relative to the bracket/body/housing, or portions thereof. The threaded member 31 or one or more ends 31*a*, 31*b* may be positioned within one or more recesses/receptacle or through openings 28. As shown in the one embodiment, the pivot mechanism 30 is positioned within the bottom wall 24 of the bracket/body. The wall/interior (e.g. bottom wall) may include a first recess or receptacle 28*a*, or portions thereof (e.g. tapering towards the opening/user/appliance door). The first recess 28*a*, if used, may be configured to access or operate the threaded member 31 (e.g. proximal end, head) to drive/rotate the threaded member. The threaded member 31 may be driven along the rotational axis R or downwardly and away from the bracket or appliance housing. The wall/rear-facing 26/rear wall (e.g. bottom wall) may include a second recess or receptacle 28*b*, of portions thereof (e.g. rear-facing). The second recess 28*b*, if used, may be configured to pass/deploy/stow the threaded member 31 (e.g. distal end or pad, of used) to engage/disengage from the wall 5. The one or more walls/surfaces defining the second recess 28*b* may interfere with structure defining the outer periphery of the pad or distal end to prevent rotation therebetween. As shown in the one embodiment in FIGS. 7-11, the bottom surface 28*aa* and 28*ba* of the first/second recess 28*a*, 28*b* may be angled downwardly. As shown in the one embodiment in FIGS. 1-6, the bottom surface 28*aa* of the first recess 28*a* may be angled downwardly, while the second recess 28*b* does not include and angles/guide surface. In some embodiments, the first recess 28*a* or interior may be angled to provide an angled approach for a power tool or handheld tool to operate the threaded member 31. In some embodiments, the distal end 31*a* of the threaded member 31 may not extend below the outer extent of the bracket (e.g. bottom, rear) or out of the second recess or outer periphery of the bracket when in the deployed position. In the deployed position, the distal end and/or pad may extend away from or out of the extent of the bracket or second recess or outer periphery of the bracket. In some embodiments, the proximal end 31*b* of the threaded member may not extend above the top surface of the bottom wall or interior when in the stowed position and/or deployed position. The appliance may be supported/stowed or received by the bracket when the threaded member is in the stowed position, deployed position, or both the stowed and deployed position.

In some implementation, the threaded aperture may be a variety of shapes, sizes, quantities, and constructions. In the one embodiment shown in FIGS. 1-5, the threaded aperture 33 may be a member/block 33*a* (e.g. with threads) retained to the bracket/body by a clip 33*b*, if used (e.g. spring loaded engagement to body). In the one embodiment shown in FIG. 6, the aperture 33 may be a threaded receptacle 33*c* (e.g. cylindrical) having a lip 33*d*, if used, extending radially outward from one end. In other embodiments as shown in FIGS. 7-11, the body/bracket 20, 22 (e.g. one or more walls/surfaces), or portions thereof, may include or define a threaded aperture 33. The threaded aperture may be positioned in the one or more recesses/receptacles/through opening, if used, of the bracket, or walls thereof.

In some implementations, two or more pivot mechanisms 30 may vary one or more gaps G, or portions thereof, if needed. For example as shown in the one embodiment, one pivot mechanism may be positioned on the bottom, left rear-facing side 13, 26 of the appliance/bracket and another pivot mechanism may be positioned on the bottom, right rear-facing side 13, 26 of the appliance/bracket. One pivot mechanism may adjust the gap, or portion thereof, adjacent the front/top left edge and a second pivot mechanism may adjust the gap, or portion thereof, if any adjacent the front/top right edge.

In some implementations, the pivoting mechanism and/or bracket, or portions thereof, may be secured to the appliance. Although not shown, the bracket and/or pivot mechanism may be first attached to the appliance, secured to the wall and/or bracket, then subsequently pivoted.

In use, the user may fasten or secure the mounting bracket 20 to the wall. The wall 5 (e.g. vertical) may be proximate to an underside of a structure (e.g. wall cabinet). At least one fastener mechanism 40 may secure or attached the bracket (e.g. one or more members) to the wall. The fastener mechanism 40 may attach the upper portion 20*a* of the bracket to the wall. In some embodiments, the fastener mechanism 40 may be loose or not completely drawn into the wall to allow for pivoting of the bracket/appliance adjacent thereto. Alternatively, the fastener mechanism may be tight or completely drawn into the wall. The bracket 20 may include one or more pivot mechanisms 30. The one or more pivot mechanisms 30 may be adjacent the bottom end 20*b* of the bracket/appliance and/or below the fastener mechanism/fastener 40, 41 at a lower elevation. The pivot mechanism 30 may include the threaded member 31. The user may rotate the threaded member 31 relative to the bracket/body/aperture. The user may pivot the bracket/appliance upwardly/downwardly depending on the direction of rotation or desired gap, or lack thereof. The pivoting of the bracket may be upwardly to narrow one or more gaps, if any, between the bracket/appliance and the underside of the cabinet. The pivot mechanism and/or threaded member may be deployed or rotated before and/or after securing the bracket to the wall. The rotation of the threaded member may be operated by the user towards the front-facing side of the bracket/appliance and/or from within the bracket/appliance. The threaded member may be deployed from the stowed position within the bracket/aperture/body. The threaded member may increase in length from the rear-facing side/wall of the bracket when deploying and/or decrease when stowing. The threaded member/aperture may be angled relative to the wall/bracket (e.g. rear-facing side). The user may place or attach the appliance to the bracket (e.g. before or after pivoting the bracket). Although the cooking appliance may pivot with the mounting bracket, the bracket may be pivoted before placing or attaching the appliance to the bracket. The pivoting may narrow the gap G between the bracket/appliance and the underside of the cabinet. The threaded member may push against the wall with one or more pads 32, if used. The pads, if used, may reduce vibration. Two or more pivot mechanisms (e.g. left, right, top, bottom) may be used to pivot portions of the appliance/bracket (e.g. lateral sides of the bracket/appliance) to narrow the gap, or portions thereof, or pivot. The fastener mechanism, if previously loose, may be tightened or fixed to hold the pivot position and/or bracket. The tightening may be done before or after the appliance is placed or attached with the bracket, or portions thereof.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. An over-the-range cooking appliance configured for mounting to an underside of a wall cabinet, the over-the-range cooking appliance comprising:

a housing including a cooking cavity configured to receive food; and a bracket configured to support the housing, wherein the bracket includes a body and a threaded member threadably coupled to the body, wherein rotation of the threaded member relative to the body is configured to pivot the bracket and/or housing upwardly towards the underside of the wall cabinet.

2. The over-the-range cooking appliance of claim 1 wherein the threaded member includes a proximal end and a distal end, wherein the distal end includes a pad.

3. The over-the-range cooking appliance of claim 2 wherein the body of the bracket rotatably fixes the pad thereto.

4. The over-the-range cooking appliance of claim 2 wherein the pad rotates with the threaded member.

5. The over-the-range cooking appliance of claim 2 wherein the pad of the distal end is rotated from a first axial position proximate the body of the bracket to a second axial position distal from the body.

6. The over-the-range cooking appliance of claim 1 wherein a distal end of the threaded member is configured to contact a wall disposed proximate to the wall cabinet.

7. The over-the-range cooking appliance of claim 1 wherein the body includes a rear facing side and a front facing side, and wherein an axis of the threaded member is angled relative to the rear facing side facing a wall disposed proximate to the wall cabinet.

8. The over-the-range cooking appliance of claim 1 wherein the body includes a bottom wall, wherein the bottom wall includes a recess configured to access and drive the threaded member.

9. The over-the-range cooking appliance of claim 1 wherein the threaded member is proximate a bottom end of the body of the bracket and a pivoting axis of the body of the bracket is proximate a top end of the body of the bracket.

10. The over-the-range cooking appliance of claim 1 wherein the threaded member is threaded in a linear direction between a stowed position within the body of the bracket and a deployed position different from the stowed position, when in the stowed position the bracket is pivoted less than when in the deployed position.

11. The over-the-range cooking appliance of claim 1 wherein the bracket is pivoted upwardly towards the underside of the wall cabinet when rotating the threaded member.

12. A mounting bracket for an over-the-range cooking appliance comprising:

a body having a fastener mechanism and a pivoting mechanism, wherein the fastener mechanism is adjacent a top end of the body and the pivoting mechanism is adjacent a bottom end of the body; and wherein the pivoting mechanism includes a threaded aperture within the body and a threaded member rotatably engaging the threaded aperture between a stowed position and a deployed position different from the stowed position, wherein the body of the bracket is in a first pivot position about the fastener mechanism when in the stowed position and a second pivot position about the fastener mechanism different from the first pivot position.

13. The mounting bracket of claim 12 wherein a length of the threaded member is increased away from the threaded aperture from the stowed position towards the deployed position.

14. The mounting bracket of claim 12 wherein the threaded member includes a proximal end configured to be operated by the user and a distal end configured to engage a wall.

15. The mounting bracket of claim 14 wherein the proximal end of the threaded member includes a pad rotational fixed or freely rotatable relative to a remaining portion of the threaded member.

16. The mounting bracket of claim 15 wherein the body includes a top wall, a bottom wall, and a plurality of side walls connecting the top wall to the bottom wall, wherein the bottom wall includes the pivoting mechanism.

17. The mounting bracket of claim 12 wherein the threaded member is rotatable about a rotational axis transverse to a rear-facing surface of the bracket body.

18. A method of pivoting a mounting bracket for an over-the-range cooking appliance comprising the steps of:

providing a mounting bracket, wherein the mounting bracket is configured to support the over-the-range cooking appliance;

fastening the mounting bracket to a wall disposed proximate to an underside of a wall cabinet;

rotating a threaded member of the mounting bracket; and pivoting the mounting bracket upwardly to narrow a gap between the mounting bracket and the underside of the wall cabinet.

19. The method of claim 18 further comprising placing the over-the-range cooking appliance on the mounting bracket.

20. The method of claim 19 wherein placing the over-the-range cooking appliance on the mounting bracket occurs after pivoting the mounting bracket.

21. The method of claim 19 further comprising pivoting the over-the-range cooking appliance to narrow the gap.

22. The method of claim 18 wherein rotating the threaded member is from within the mounting bracket.

23. The method of claim 18 wherein rotating the threaded member is at an angle relative to the wall.

24. The method of claim 18 further comprising deploying the threaded member from a stowed position within the mounting bracket.

25. The method of claim 18 further comprising narrowing the gap with a plurality of the threaded members.

* * * * *